US005199493A

United States Patent [19]

Sodder, Jr.

[11] Patent Number: 5,199,493

[45] Date of Patent: Apr. 6, 1993

[54] METHODS AND APPARATUS FOR SHUTTING A CONDUIT

[76] Inventor: George Sodder, Jr., 51 Maple St., Falls Views, W. Va. 25309

[21] Appl. No.: 886,153

[22] Filed: May 21, 1992

Related U.S. Application Data

[63] Continuation-in-part of Ser. No. 695,202, May 3, 1991.

[51] Int. Cl.[5] ..... E21B 29/08

[52] U.S. Cl. ..... 166/297; 166/55

[58] Field of Search ..... 166/55-55.8, 166/297

[56] References Cited

U.S. PATENT DOCUMENTS 4,580,626 4/1986 Jones ..... 166/55

4,646,825 3/1987 Van Winkle ..... 166/55

*Primary Examiner*—Thuy M. Bui

*Attorney, Agent, or Firm*—Burns, Doane, Swecker & Mathis

[57] ABSTRACT

A conduit is shut off by a shut-off valve mechanism which is attached to an external periphery of an exposed region of the conduit. That region is exposed by excavation from the ground surface. A drill mounted on the fixture is actuated to cut out a section of the conduit. A sealing shoe mechanism carried by the drill is positioned within the cut-out section of the conduit and is actuated to make sealing contact with the cut edges of the conduit in order to block the passage of fluid therethrough. Alternatively, the drill can be eliminated by preforming a gap between two sections of the conduit and providing the body with a through-hole which is aligned with the conduit sections until the sealing shoe is displaced into the gap.

17 Claims, 4 Drawing Sheets

FIG. 1
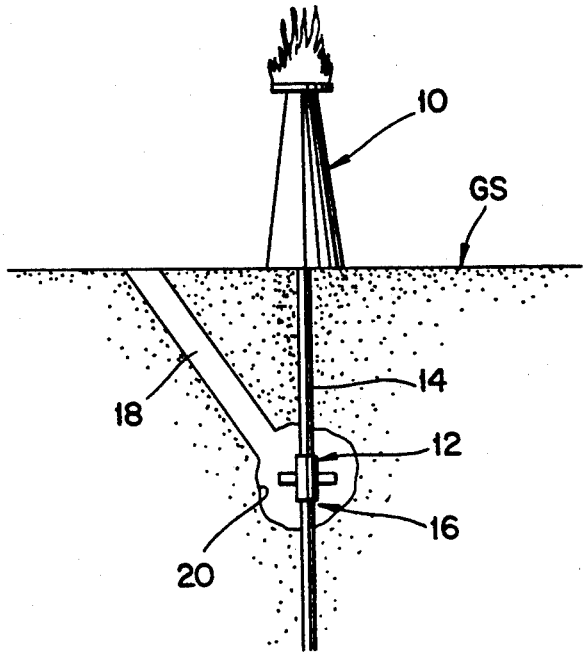
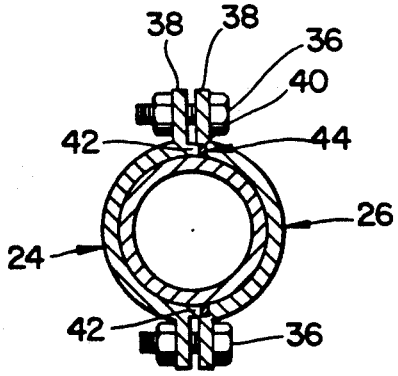
FIG. 4
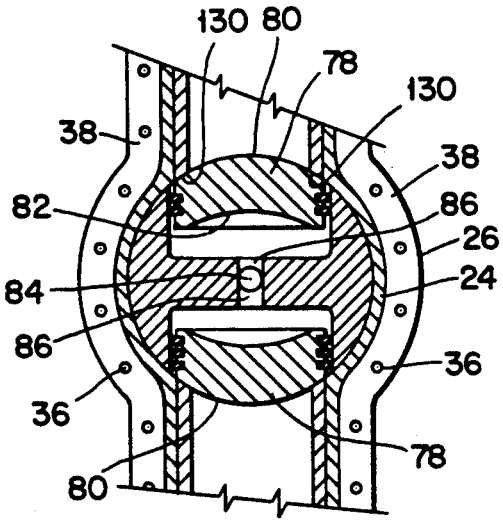
FIG. 5

METHODS AND APPARATUS FOR SHUTTING A CONDUIT

RELATED APPLICATION

This is a continuation-in-part of U.S. Ser. No. 07/695,202 filed May 3, 1991.

BACKGROUND OF THE INVENTION

The present invention relates to methods and apparatus for shutting a conduit.

In order to extinguish a burning oil or gas well, it has previously been the practice to apply fire-dousing materials to the upper end of the well pipe at the source of the fire. Such a practice is highly difficult and dangerous due to the intense heat encountered from the flames. Also, some extinguishing techniques result in a clogging of the well pipe, requiring considerable effort to reopen the pipe. It would be desirable to be able to extinguish the fire while remaining at a safe distance from the flames.

It would also be desirable to be able to attach a shut-off valve to other types of fluid pipes such as buried water or natural gas transport pipes for example. In many cases such transport pipes are branched from a main pipe. If a branch line bursts, it may be necessary to close down the entire pipe system, including other branches which have not ruptured. It would be desirable to be able to shut-off only the ruptured branch.

SUMMARY OF THE INVENTION

One aspect of the present invention involves an apparatus adapted to be attached to an on-line fluid pipe for shutting off the pipe. The apparatus comprises a fixture arranged to be affixed to the exterior of the fluid pipe, and a pipe shut-off mechanism carried by the fixture. The shut-off mechanism includes a pipe cutter, a drive mechanism for driving the pipe cutter to cut out a section of the pipe, a pipe sealing mechanism, and a displacement mechanism for displacing the pipe sealing mechanism into contact with cut edges of the pipe to block the passage of fluid through the pipe.

Preferably, the pipe sealing mechanism is connected to the cutter for movement therewith to a position disposed within the cut-out pipe section.

Preferably, the fixture includes first and second fixture sections. Each fixture section has a mounting portion for being attached to an external surface of the pipe, and a cylindrical drill housing extending laterally from the mounting portion. The drill housings of the first and second fixture sections are mutually aligned on opposite sides of the pipe. The drill is initially disposed in the drill housing of the first fixture section and is arranged to enter the drill housing of the second fixture section after cutting through the pipe.

Preferably, the pipe cutter comprises a rotary drill which is axially displaceable, and the pipe sealing mechanism comprises sealing shoes mounted on the drill for displacement therewith.

Another aspect of the invention involves an apparatus for shutting off a fluid flow which comprises a fixture configured to be connected to a fluid conduit at a location where a gap is formed between two conduit sections. A conduit shut-off mechanism is carried by the fixture and includes a body mounted in the fixture for movement in a first direction extending transversely of axis defined by the fluid conduit. The body is sized to fit within the gap formed between the conduit section. The body includes at least one pocket formed in an outer periphery thereof. A conduit-sealing member is mounted in the pocket for movement relative to the body between retracted and extended positions in a second direction extending transversely of the first direction of movement. A pressurizable chamber is formed between the conduit-sealing member and the pocket. A fluid pressure seal is formed between the conduit-sealing member and the pocket. An actuating mechanism drives the body in the first direction orienting the conduit-sealing member in the gap and for pressurizing the chamber with pressurized fluid for displacing the conduit-sealing member in the second direction against an end face of one of the conduit sections to block the flow of fluid between the conduit sections.

Preferably, the body includes a through-hole spaced from the pocket and extending in the second direction. The through-hole is alignable with the conduit sections to conduct fluid therebetween. The through-hole is displaced out of alignment with the conduit sections when the conduit sealing member is oriented in the gap.

Another aspect of the invention involves a method of shutting off an on-line buried fluid pipe. The method comprises excavating in order to provide access to a region of the pipe from the ground surface. A fixture is attached to an external periphery of the excavated region of the pipe. A cutting mechanism which is mounted on the fixture is actuated to cut out a section of the pipe, such that a pipe sealing mechanism, which is connected to the cutting means for movement therewith, becomes situated within the cut-out pipe section. The pipe sealing mechanism is displaced outwardly into sealing contact with the pipe to block the passage of fluid therethrough.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 1 is a schematic side elevational view of an on-line oil or gas well pipe to which the present invention is applied;

FIG. 2 is a vertical sectional view taken through a shut-off valve mechanism according to the present invention after the mechanism has been attached to an on-line pipe, but before the pipe has been cut through;

FIG. 4 is a cross-sectional view taken along line 4—4 in FIG. 2;

FIG. 5 is a vertical sectional view taken along the line 5—5 in FIG. 3;

DETAILED DESCRIPTION OF A PREFERRED EMBODIMENT OF THE INVENTION

Figure 2:
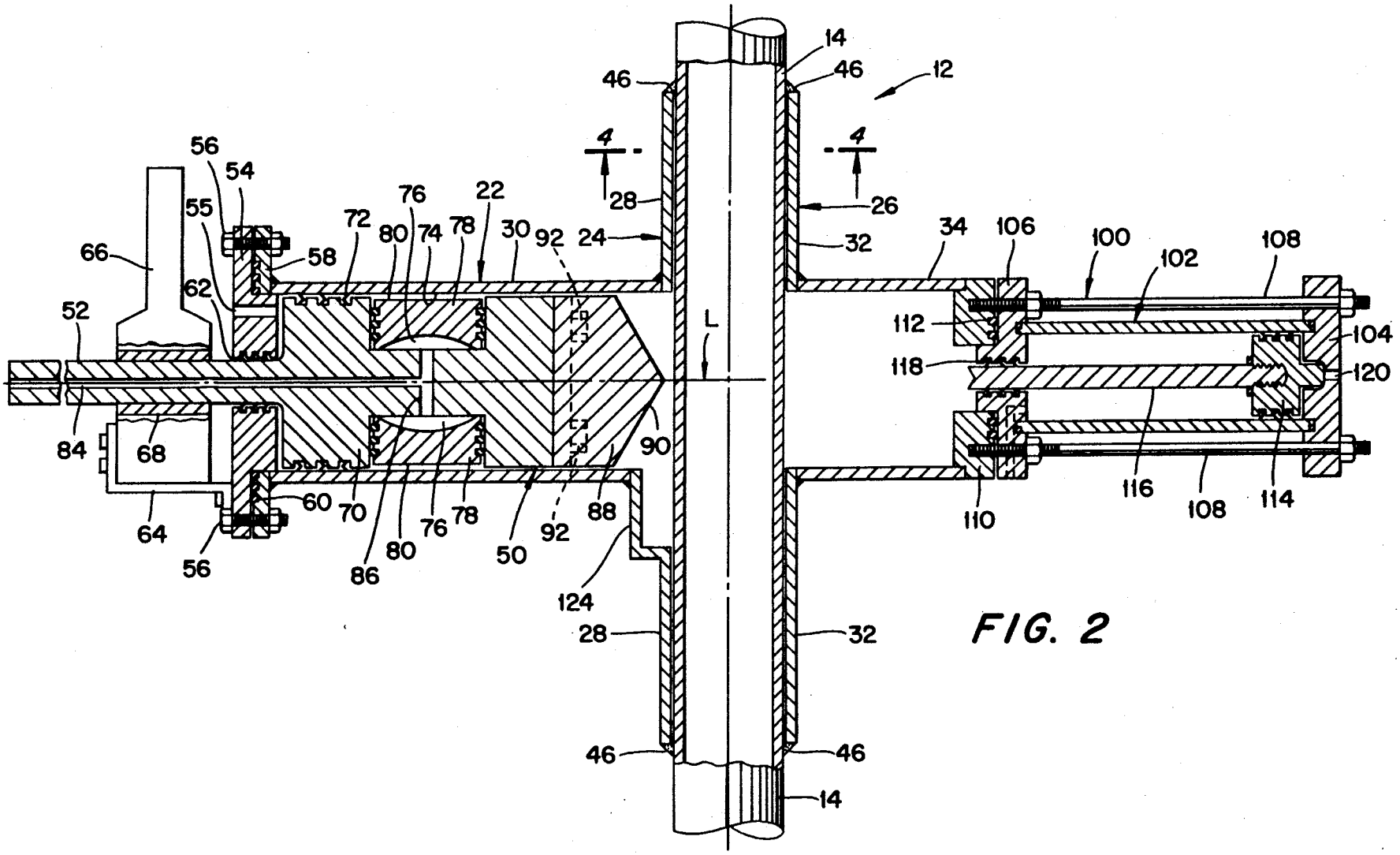

Depicted in FIG. 1 is a burning oil or gas well 10. In accordance with the present invention, the fire is to be extinguished by attaching a pipe shut-off mechanism 12 to the buried well pipe or conduit 14 at a remote location 16 below the ground surface GS and the flame, and then actuating the shut-off mechanism to block the flow of oil or gas to the ground surface to extinguish the flame.

To provide access to the remote location 16, the ground is excavated by drilling a shaft 18 down to the pipe from the ground surface. The shaft is originated sufficiently far from the flames so that workers can operate in relative safety.

Once the pipe 14 has been reached, an area 20 surrounding the pipe is excavated by workers to enable the shut-off mechanism 12 to be attached to the pipe 14. The shut-off mechanism 12 comprises a fixture 22 which includes first and second sections 24, 26 (FIGS. 2, 3) which are clamped together around the pipe and then welded to the pipe.

The first fixture section 24 includes a first vertical semi-cylindrical mounting portion 28 and a first cylindrical drill housing 30 extending horizontally laterally therefrom.

The second fixture section 26 includes a second vertical semi-cylindrical mounting section 32 and a second cylindrical drill housing 34 projecting horizontally laterally therefrom.

The fixture sections 24, 26 are joined to one another by means of bolts 36 passing through lateral flange portions 38 of the fixture sections (see FIG. 4). One of the fixture sections 26 includes grooves 40 which receive tongue-like extensions 42 of the other fixture section 24, as depicted in FIG. 4. A seal 44 is clamped between each pair of tongue and groove. Each of the mounting sections 28 32 may include an inner lining formed of a malleable material such as a babbitt metal which will conform to irregularities in the outer surface of the pipe 14. That lining creates a fluid seal between the pipe 14 and the fixture 22. Preferably, the fixture sections 24, 26 are also secured by welds 46 (FIG. 2) to the well pipe 14 to augment the seal and prevent any relative movement between the fixture and pipe.

The fixture sections 24, 26 are joined together such that the first and second drill housings 30, 34 are co-axially aligned along a common longitudinal axis L. Disposed within a cross-bore formed by the first drill housing 30 is a body forming a drill shaft 50 which is adapted for both rotational and axial movement relative to the fixture. A rear end of the drill shaft comprises a cylindrical drive shaft portion 52 which projects through an end wall 54 of the first drill housing 30. The latter is attached by suitable bolts 56 to an end flange 58 of the first drill housing 30, and sealed by suitable seal rings 60. The end wall 54 includes a central aperture 62 through which the drive shaft portion extends. O-rings disposed around the aperture 62 periphery create a suitable fluid seal with the drive shaft portion 52 as the drill shaft rotates and slides axially, as will be explained.

The end wall 54 also includes a port 55 to which a source of pressurized fluid can be coupled in order to pressurize the first piston housing 30 for advancing the drill shaft 50.

Connected to the fixture by a bracket 64 which is bolted to the end wall 54, is a conventional rotary motor 66 having an output shaft in the form of a hollow sleeve 68. The drive shaft portion 52 is keyed to the sleeve to be rotatably driven thereby, while being axially slidable relative thereto.

Alternatively, the motor could be affixed to the drive shaft portion 52 and guided for axial movement relative to the fixture; hence, the motor would travel axially with the drive shaft.

At the front end of the drill shaft there is disposed a piston 70 which carries seal rings 72 creating a fluid seal with the inner surface 74 of the first drill housing 30. The piston is cylindrical and includes two diametrically opposite, cylindrically shaped pockets 76 which face radially outwardly. Slidably disposed within the pockets are a pair of sealing shoes 78. The shoes and pockets form pressurizable chambers at inner ends of the shoes. Each sealing shoe 78 includes a cylindrical outer surface carrying seal rings forming a fluid seal with a cylindrical surface of the respective pocket 76.

An outwardly facing sealing surface 80 of each shoe is of arc-shaped configuration (see FIG. 5), the curvature of which being concentric with the longitudinal axis L. An inner surface 82 of each sealing shoe is of concave spherical configuration. A fluid passage 84 extends axially forwardly through both the drive shaft portion 52 and the piston 70 and then bifurcates into two radial branches 86 which open into the pressurizable chambers of respective ones of the pockets 76. By connecting the rear end of the fluid passage 84 to a source of fluid pressure (e.g., hydraulic pressure) and conducting that pressurized fluid to the pockets 76, the sealing shoes can be displaced outwardly.

Mounted at the front end of the piston 70 is a drill bit 88, such as a conventional spade bit having cutting edges 90 extending outwardly from a center of the bit. The drill bit includes side flanges which are attached by bolts 92 to the piston 70.

Mounted to an end of the second drill housing 34 is a retractor assembly 100 which comprises a retractor cylinder 102 closed at its ends by a pair of end plates 104, 106. Those end plates are interconnected by bolts 108 which also connect the retractor assembly 100 to an end plate 110 of the second drill housing 23. Seal rings are clamped between the end plates 106, 110 to isolate the interior of the second drill housing 34 from the ambient surroundings.

Disposed within the retractor cylinder 102 is a piston/piston rod arrangement 114, 116. The piston rod 116 passes axially through one of the end plates 106 and is sealed relative thereto by seal rings 118 carried by the end plate 106. The end plate 104 includes a fluid port 120 for admitting pressurized fluid to the reactor cylinder 102 for displacing the piston 114.

In operation, once a shaft 18 has been excavated from the ground surface GS to the selected remote section 16 of the well pipe 14 to be closed, the area 20 is cleared from around the well pipe. The two fixture sections 24, 26 are then attached to the drill pipe by the bolts 36 and the weld joints 46.

Figure 3:
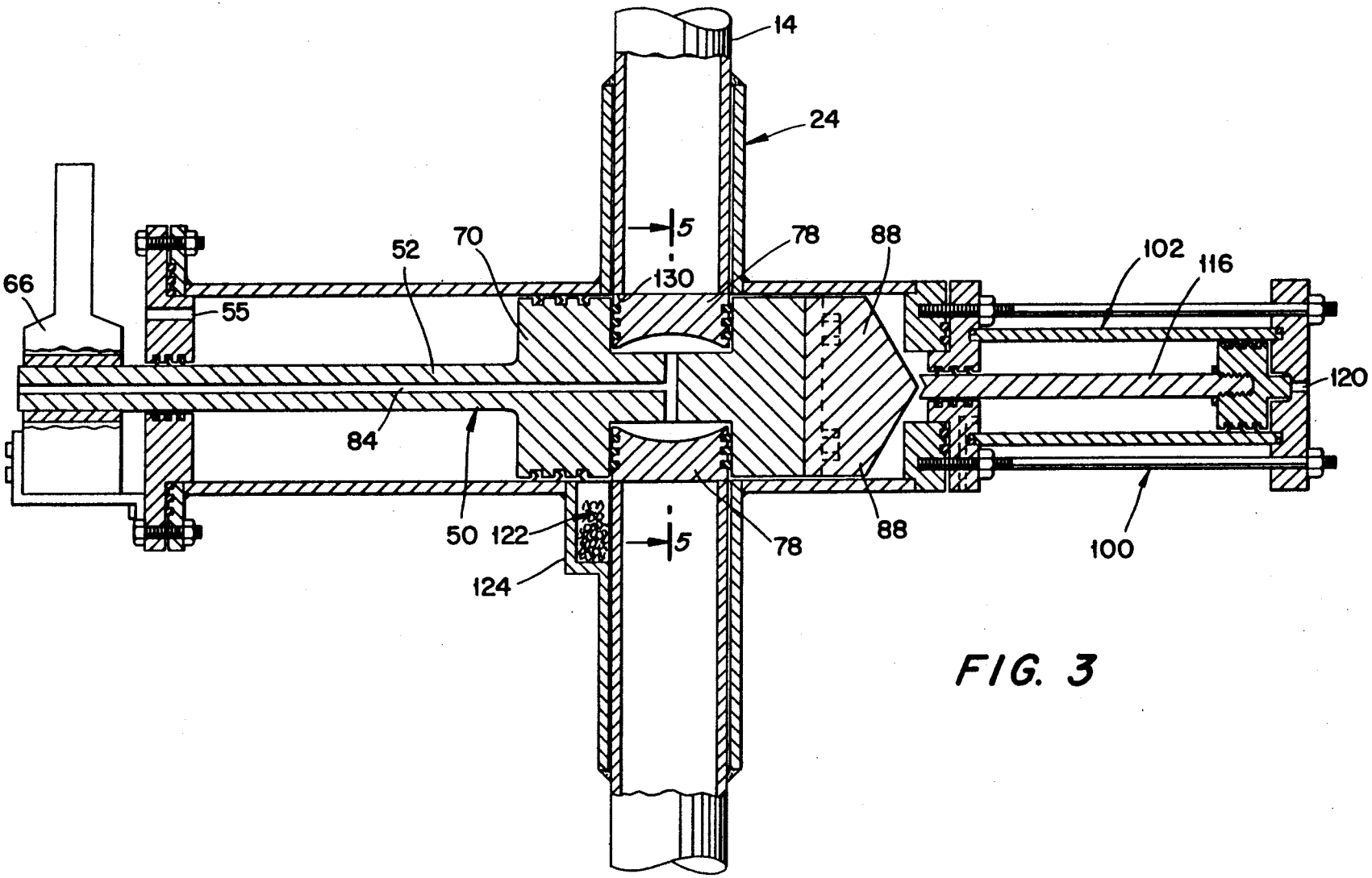
FIG. 3 is a view similar to FIG. 2 after a drill of the shut-off valve mechanism has cut through the on-line pipe.

Thereafter, the drill shaft 50 is rotated by the motor 66 while being simultaneously advanced axially forwardly by the admission of pressurized fluid into the drill housing 30 through the fluid port 55 in the end wall 54. As a result of such rotation and axial advancement, the drill bit cuts out a section of the drill pipe as depicted in FIG. 3. Chips 122 formed during an initial phase of the cutting action can fall into a chip reservoir 124 located at a lower front region of the first drill housing 30. When the drilling is completed, the drill shaft 50 is advanced into the gap formed by the cut-out pipe section until the sealing shoes 78 are centered within the drill pipe, and are disposed in vertically superimposed relationship.

Such positioning of the sealing shoes 78 can be achieved in various ways. For example, the drive shaft can be provided with marks on its outer periphery which become aligned with corresponding marks on fixed surfaces, such as surfaces of the motor 66 or end wall 54.

By then passing pressurized fluid through the passages 84, 86 of the drill shaft 50 and into the pockets 76 of the piston 70, the sealing shoes 78 will be extended outwardly into sealing contact with the cut edges 130 of the well pipe (see FIGS. 3 and 5), thereby blocking the vertical travel of oil or gas upwardly through the well pipe.

Accordingly, the fire will be effectively extinguished when the residual oil or gas disposed within the well pipe above the shut-off mechanism 112 has been consumed. Thereafter, when it is desired to reopen the well pipe 14, pressurized fluid is admitted to the retractor cylinder 102 of the retractor assembly 100 to displace the retractor piston rod 116 toward the drill shaft 50 to push the drill piston 70 and drill bit 88 out of the well pipe 14 and into the first drill housing 30. Then, the fixture sections 24, 26 can be removed from the well pipe to enable the well pipe to be repaired for subsequent use.

It will be appreciated that the present invention enables a shut-off valve mechanism to be installed in an in-line oil or gas well at a location below the ground surface. Consequently a burning oil or gas well can be extinguished while the personnel remain at a safe distance from the flames.

The apparatus is also applicable to other types of on-line pipes, such as buried or emersed horizontal pipes for transporting fluids like water and natural gas for example. In the event that a branch line of such a pipe system ruptures, the present invention can be used to shut-off only that branch line without having to shut-off the remaining branch lines, or a main line. Hence, the branch line can be repaired while the fluid continues to flow in the other branch lines and/or the main line.

Figure 6:
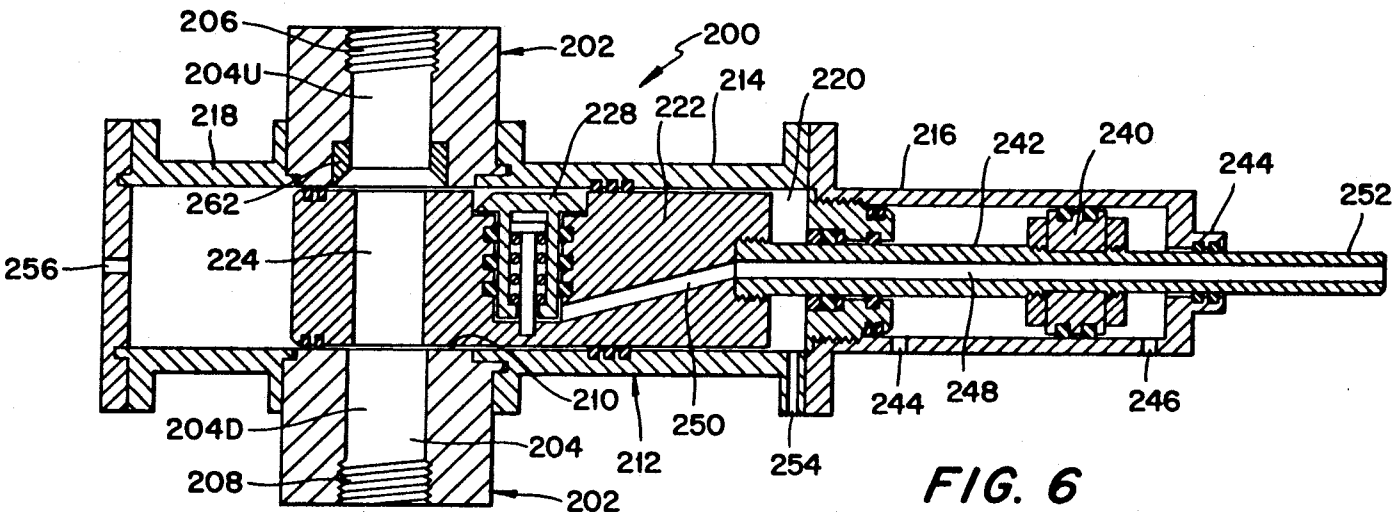
FIG. 6 is a longitudinal sectional view of another embodiment of the invention in a non-shut off position.
Figure 7:
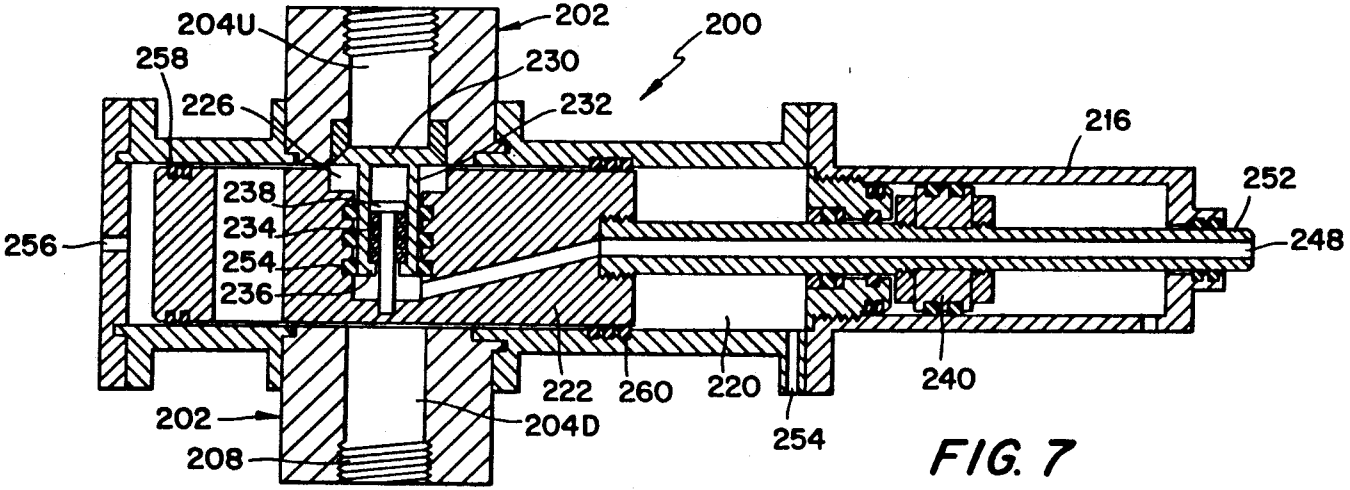
FIG. 7 is a view similar to FIG. 6 in a conduit shut off position.

The afore-described mechanism is suited to shutting off the flow of fluid when no such means has been inherently provided in the conduit. However, it is possible to incorporate a shut-off mechanism into the conduit. Such a built-in shut-off mechanism 200 is depicted in FIGS. 6 and 7. That mechanism comprises a housing 202 in which a conduit 204 is formed. Opposite ends 206, 208 of the conduit are threaded, so that the threaded ends of respective pipe sections can be attached thereto.

Extending perpendicular to the conduit 204 and in intersecting relationship thereto, is a cylindrical cross-bore 210. The cross-bore 210 defines a gap between upstream and downstream sections 204U, 204D of the conduit 204.

Fixedly attached to the housing 202 is a fixture 212. The fixture includes first, second and third cylindrical portions 214, 216, 218. The first portion 214 forms a cylindrical bore 220 in which a cylindrical body 222 is slidably mounted. The body 222 incudes a through-hole 224 which extends perpendicularly to the longitudinal axis of the body. That through-hole can be positioned in alignment with the axis of the conduit so as to conduct fluid between the conduit sections 204U, 204D.

A pocket 226 is formed in an outer periphery of the body 222. Mounted within the pocket 226 is a conduit-sealing member 228 which is radially displaceable between an inner retracted position (FIG. 6) and an outer extended position (FIG. 7). The member 228 includes a sealing head 230 which includes a sealing surface preferably formed of a relatively ductile material, such as copper for example which is applied by a copper electroplating operation. The member 228 also includes a hollow cylindrical stem 232. Situated within the stem 232 is a coil compression spring 234. An inner end of the spring sits upon an inwardly extending shoulder 236 of the stem. An upper end of the spring bears against the head 238 of a bolt which is attached to the body 222. Hence, when the member 232 is in its extended position, the spring 234 is compressed and biases the member 232 toward its retracted position.

The body 222 is displaceable by means of a cylinder/-piston mechanism. The cylinder of that mechanism is defined by the second portion 216 of the fixture. The piston 240 is slidably disposed in the cylinder and is connected to the body 222 by a hollow rod 242. Ports 244, 246 are formed in the cylinder 216 to enable pressurized fluid to be inserted into, and removed from, the cylinder, in order to displace the piston 240 and body 222.

The hollow piston rod 242 extends completely through the piston 240 and through a rear end 244 of the cylinder 216. The piston rod 242 forms an internal passage 248 which communicates with a passage 250 in the body, the latter passage leading to the pocket 226. A fluid hose (not shown) can be attached to a rear end 252 of the piston rod to enable pressurized fluid (preferably hydraulic fluid) to be delivered via the rod 242 to a chamber formed between the pocket and the conduit sealing member 232. Suitable seals 254 are provided between the pocket and the member 228, so that pressurized fluid delivered to that pressure chamber will displace the member 228 to its extended position against the bias of the spring 234.

The first portion 214 of the fixture 212 includes a vent 254 which facilitates movement of the body 222 when the piston 240 is energized. When the body 222 is displaced to the left in FIG. 6, the front end of the body 222 enters the third portion 218 of the fixture. That portion is also provided with a vent 256 to facilitate displacement of the body 222 therein.

The body 222 carries first and second sets of seal rings 258, 260 which are spaced along the axis of the body 222 such that the through-hole 224 and pocket 226 are located between the first and second sets of seal rings 258, 260. The seal rings 258, 260 prevent leakage of fluid traveling through the conduit 204.

IN OPERATION, the body 222 is normally situated in such a position that the through-hole 224 is aligned with the conduit sections 204U, 204D in order to permit fluid to flow through the conduit. Fluid is sealed within the fixture by the sets of seal rings 258, 268. The conduit-sealing member 228 is disposed in its retracted position such that it does not extend outwardly past the outer periphery of the body 222 (see FIG. 6).

When it is desired to shut off the conduit, the piston 240 is energized to displace the body such that the through-hole 224 moves out of the gap disposed between the conduit sections, and the conduit-sealing member 228 enters that gap in opposing relationship to a valve seat 262 formed in one of the conduit sections, preferably the upstream section 204U. That valve seat thus forms an end face of the conduit section 204U.

By then conducting pressurized fluid through the passage 250, the conduit-sealing member 228 is displaced to its extended position such that the sealing head 230 travels outside of the outer periphery of the body and sealingly engages the seat 262. Flow through the conduit is thus terminated.

When it is desired to reopen the conduit, pressure in the conduit 250 is relieved, so that the spring 234 returns the conduit-sealing member 228 to its retracted position. Then, the piston 240 is energized to displace the body rearwardly (to the right in FIG. 6) until the through-hole 224 is again aligned with the conduit axis.

If desired, there could be provided two pockets 226 oriented diametrically apart, with a conduit-sealing member 228 disposed in each pocket. Such a dual-head arrangement would function to close-off both of the conduit sections 204U, 204D.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. Apparatus for shutting off a fluid pipe, comprising:

a fixture configured to be positioned around the exterior of the fluid pipe at a location intermediate the pipe ends, and pipe shut-off means carried by said fixture and including:

pipe cutting means mounted in said fixture for movement in a direction extending transversely of a first axis defined by the pipe, and mounted for rotation about a second axis extending in said direction of movement, drive means for rotating said pipe cutting means about said second axis and simultaneously driving said pipe cutting means forwardly in said direction of movement to cut out a section of the pipe and form a gap between remaining upstream and downstream sections of the pipe, a body movable in a direction extending transversely of said first axis, said body being positioned and sized to fit within said gap, said body including at least one pocket formed in an outer periphery thereof, a pipe sealing member mounted in said pocket for inward and outward movement relative thereto between retracted and extended positions in a direction extending transversely of said direction of movement of said body; and displacing means for displacing said pipe sealing member to said extended position and into contact with an end face of one of said remaining pipe sections to block the passage of fluid.

2. Apparatus according to claim 1, wherein said pipe cutting means is mounted on said body.

3. Apparatus according to claim 1, wherein said displacing means comprises means for introducing pressurized fluid into said pocket.

4. Apparatus according to claim 1, wherein there are two said pipe sealing members mounted in respective pockets, said pipe sealing members being aligned with one another and arranged to contact the end faces of respective pipe sections.

5. Apparatus according to claim 1, wherein said pipe cutting means comprises a rotary drill.

6. Apparatus according to claim 5, wherein said fixture includes first and second fixture sections, each fixture section having a mounting portion for being attached to an external surface of the pipe, and a cylindrical drill housing extending laterally from said mounting portion, said drill housings of said first and second fixture sections being mutually aligned on opposite sides of the pipe, said drill being initially disposed in said drill housing of said first fixture section and arranged to enter said drill housing of said second fixture section after cutting through the pipe.

7. Apparatus according to claim 6 including retractor means mounted in said drill housing of said second fixture section for pushing said drill and said body rearwardly and back into said drill housing of said first fixture section.

8. Apparatus according to claim 1, wherein said pipe sealing member carries a sealing surface for sealingly contacting the end face of one of the remaining pipe sections, said sealing surface being curved about an axis coinciding with said second axis.

9. Apparatus according to claim 1, wherein said body comprises a cylindrical piston mounted in said fixture for rotation about said second axis and for linear displacement in said first direction, said pipe cutting means comprising a drill mounted at a front end of said piston for rotation therewith, said at least one pocket being formed in said piston, said displacing means comprising means for introducing pressurized fluid into a chamber formed in said pocket between said pipe sealing means and an inner end of said pocket.

10. Apparatus for shutting off a conduit, comprising:

a fixture configured to be connected to a fluid conduit at a location where a gap is formed between two conduit sections, and conduit shut-off means carried by said fixture and including:

a body mounted in said fixture for movement in a first direction extending transversely of an axis defined by the fluid conduit, said body being sized to fit within the gap formed between the conduit sections, said body including at least one pocket formed in an outer periphery thereof, a conduit-sealing member mounted in said pocket for movement relative to said body between retracted and extended positions in a second direction extending transversely of said first direction of movement, a pressurizable chamber formed between said conduit-sealing member and said pocket, means forming a fluid pressure seal between said conduit-sealing member and said pocket, and actuating means for driving said body in said first direction for orienting said conduit-sealing member in said gap, and for pressurizing said chamber with pressurized fluid for displacing said conduit-sealing member in said second direction against an end face of one of the conduit sections to block the flow of fluid between said conduit sections.

11. Apparatus according to claim 10, wherein said body is cylindrical and includes a longitudinal axis, said conduit-sealing member carrying a sealing surface for engaging the end face of the one conduit section, said sealing surface being curved about an axis coinciding with said longitudinal axis of said body.

12. Apparatus according to claim 10, wherein said body includes a through-hole spaced from said pocket and extending in said second direction, said through-hole being alignable with the conduit sections to conduct fluid therebetween, said through-hole being displaced out of alignment with the conduit sections when said conduit-sealing member is oriented in said gap.

13. Apparatus for shutting off a conduit, comprising:

first and second conduit sections forming a gap therebetween, a fixture attached to said first and second conduit sections and forming a cross-bore extending perpendicular to an axis defined by said first and second conduit sections, conduit shut-off means carried by said fixture and including:

a cylindrical body mounted in said cross-bore for sliding movement therein and sized to fit in said gap, said body including:

a pocket formed in an outer periphery of said body, and a through-hole spaced from said pocket and extending perpendicular to said cross-bore said through-hole being alignable with said conduit sections to conduct fluid therebetween, a conduit-sealing member mounted in said pocket for movement relative to said body between an inner retracted position and an outer extended position wherein a sealing surface of said conduit-sealing member is disposed outwardly beyond said outer periphery of said body, actuating means for driving said body in said cross-bore such that said through-hole is displaced out of said gap, and said conduit-sealing member is disposed in said gap in opposing relationship to one of said conduit sections, and means for delivering pressurized fluid to said pocket for displacing said conduit-sealing member to said extended position against an end face of said one conduit section to block the flow of fluid between said conduit sections.

14. Apparatus according to claim 13, wherein said actuating means comprises a cylinder connected to said fixture, a piston operably connected to said body and reciprocable within said cylinder, and means for delivering pressurized fluid to said cylinder for displacing said piston.

15. Apparatus according to claim 13 including biasing means for biasing said conduit-sealing member to said retracted position.

16. Apparatus according to claim 13 including a housing joined to said fixture, said housing forming said conduits and including means for connecting additional conduits to said conduit sections.

17. A method of shutting off an on-line buried fluid pipe, comprising the steps of:

excavating to expose and provide access to a region of the buried pipe, attaching a fixture to an external periphery of said exposed region of the pipe, actuating a cutting means mounted on the fixture to cut out a section of the pipe, such that a pipe sealing means connected to said cutting means for movement therewith becomes situated within the cut-out pipe section, and displacing said pipe sealing means outwardly into sealing contact with the pipe to block the passage of fluid therethrough.

* * * * *